US009633554B1

(12) United States Patent
Barson

(10) Patent No.: US 9,633,554 B1
(45) Date of Patent: Apr. 25, 2017

(54) FIRE ALARM LOOP CALIBRATION AND FAULT LOCATION

(71) Applicant: Honeywell International Inc., Morristown, NJ (US)

(72) Inventor: Michael Barson, Nuneaton (GB)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 14/882,627

(22) Filed: Oct. 14, 2015

(51) Int. Cl.
*G08B 29/00* (2006.01)
*G08B 29/12* (2006.01)

(52) U.S. Cl.
CPC ..... *G08B 29/123* (2013.01)

(58) Field of Classification Search
CPC ..... G08B 29/123
USPC ..... 340/514
See application file for complete search history.

(56) References Cited

U.S. PATENT DOCUMENTS

2011/0150188 A1* 6/2011 Buss ..... G08B 25/04 379/27.01
2015/0091733 A1 4/2015 Bullmore
2015/0254971 A1* 9/2015 Okeefe ..... G08B 29/126 340/511

FOREIGN PATENT DOCUMENTS

DE 29 35 335 A1 3/1981
EP 2 706 518 A1 3/2014
EP 2 804 163 A1 11/2014

OTHER PUBLICATIONS

English-language translation of Abstract for DE patent application DE 29 35 335 A1, dated Mar. 19, 1981.
English-language translation of Abstract for EP patent application EP 2 804 163 A1, Nov. 19, 2014.
Extended European search report for corresponding EP patent application EP16192961.7, dated Feb. 27, 2017.

* cited by examiner

*Primary Examiner* — Kerri McNally
(74) *Attorney, Agent, or Firm* — Husch Blackwell LLP

(57) ABSTRACT

An apparatus is provided that includes a two-wire loop having first and second conductors that connect a monitoring system with a plurality of addressable sensors and alarm devices of the monitoring system, the two-wire loop having first and second ends connected to the monitoring system, a memory that contains first respective resistance values of the first and second conductors and second respective resistance values between the first and second ends and each of the plurality of addressable sensors and alarm devices, and a processor that detects a fault in the two-wire loop by measuring third resistance values from opposing ones of the first and second ends of the two-wire loop during a scan of the plurality of addressable sensors and alarm devices and compares the third resistance values with corresponding ones of the first and second respective resistance values in the memory.

20 Claims, 3 Drawing Sheets

FIRE ALARM LOOP CALIBRATION AND FAULT LOCATION

FIELD

This application relates to monitoring systems and, more particularly, to loop parameter monitoring and calibration in analog addressable fire systems.

BACKGROUND

Monitoring systems are known to protect life and property within protected areas. Such systems are typically based upon the use of one or more sensors that detect threats within the areas.

Threats to people and assets may originate from any of a number of different sources. For example, a fire may kill or injure occupants who have become trapped by a fire in a building. Similarly, carbon monoxide from a fire may kill people in their sleep.

In order to address these threats, a number of fire sensors and alarm devices may be distributed throughout a home or business. The fire sensors may be based upon any of a number of different detection technologies (e.g., smoke, heat, toxic gases, etc.). The alarm devices may also be based upon different technologies (e.g., sounders, strobes, voice alarm speakers, etc.) and may even be integrated into the fire sensors.

In most cases, fire detectors are connected to a local control panel. Large systems may include a number of networked control panels. In the event of a threat detected via one of the sensors, the control panel may activate the alarm devices. The control panel may also send a signal that alerts a central monitoring station.

The fire sensors may be connected to the local control panel via a two-wire (2-wire) loop. The 2-wire loop may serve the dual functions of providing power to the sensors as well as providing a communication connection.

While fire alarm systems work well, they can sometimes fail to properly notify occupants of threats from fires originating within a secured area. In many cases, the failure may be attributed to failure of the communication connection provided through the 2-wire loop. This may cause some fire detectors and/or alarm devices to fail to operate properly or to otherwise report a fire. Accordingly, a need exists for better methods and apparatuses for detecting failure of 2-wire loops.

DETAILED DESCRIPTION

Figure 1:
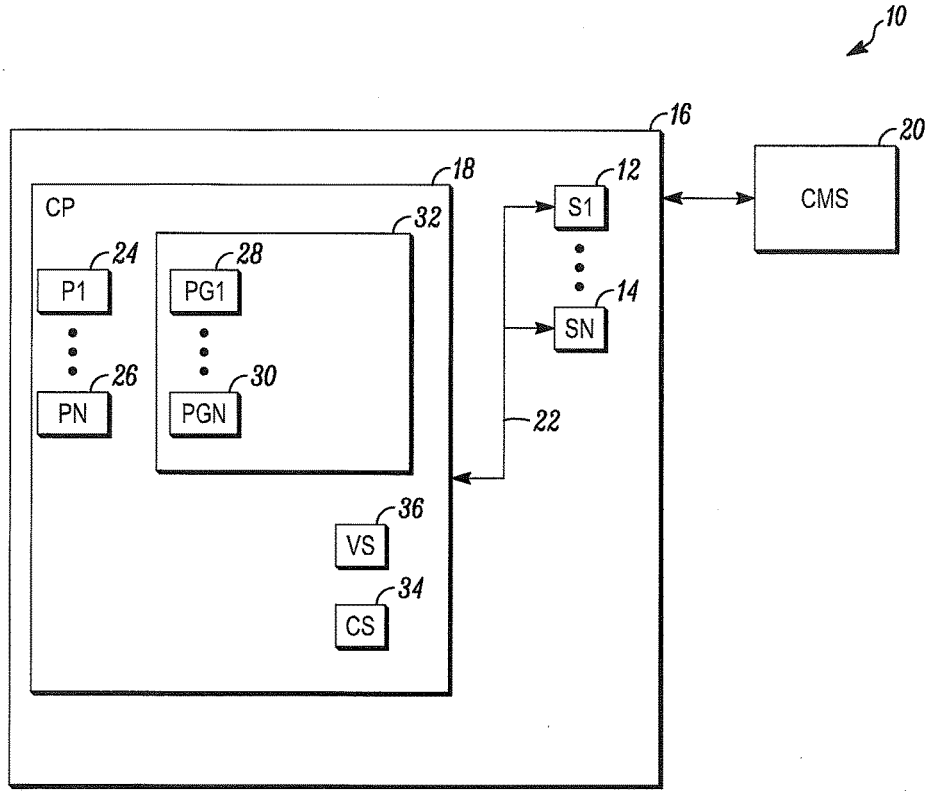
FIG. 1 is a block diagram of a monitoring system shown generally in accordance with an illustrated embodiment.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Many analog addressable fire alarm systems use combined power transmission and digital communication on a screened 2-wire loop between a control panel and a number of outstations or field devices. Generally, the outstations will mainly consist of fire detectors or sensors and alarm devices combined with a communication interface. The status of each outstation is continuously monitored by the panel so that fires or faults can be determined. If a fire is detected, then the panel will go into an alarm state and activate a number of alarm alerting devices, which, in turn, causes a large increase in loop current to occur.

The digital communication between the panel and the outstations can normally only detect quite severe loop faults such as an open circuit in the case where communication replies from outstations would only be seen on the particular end of the loop wiring still connected to the control panel. In this case, the location of the fault can be easily deduced. However, one (or even more) partial open circuits, for example, may still allow reliable digital communication. In this case, faults could remain undetected, and, when a fire is detected and the panel tries to activate the alarm devices, a complete collapse of the loop could occur.

This wiring integrity problem is known to at least some experts in the fire alarm industry, and product standards are currently being developed to address this issue with tests that require wiring faults to be detected at the earliest stage possible in order to improve the reliability of fire alarm systems.

On the other hand, with the passage of time, manufactures have required such loops to power even more devices over longer distances using alarm devices that often require significantly more power. This implies that the loop wiring has to be both monitored more accurately and with a finer resolution as it may be less tolerant to quite small increases in some loop parameters like loop resistance, i.e., a partial loop resistance fault. Additionally, on a more practical level, if such a fault (or faults) could be detected at an earlier stage, and the precise location(s) on a loop (which could be 2 Km long and contain 200 outstations) detected, then it would be highly beneficial for a commissioning or maintenance engineer.

There have been a number of prior attempts to address these issues. For example, European Patent EP2706518 A1 discloses an addressable loop system with class A wiring, which measures loop parameters, including loop resistance. However, this patent fails to disclose any method of detecting very small changes in the loop parameters, especially in the loop resistance measurement. Additionally, this patent does not disclose any method of accurately locating the actual position of one or more partial open circuits in the loop wiring.

Similarly, U.S. Publication No. US2011/0150188 A1 discloses an addressable loop system that periodically disconnects the loop from a control panel and then replaces the loop with a simulated outstation or subscriber so that the parameters of the communication circuit within the panel or a control center can be tested, i.e., it is a self-test of the control center. When the loop is re-connected, the control panel uses standard digital communication to find basic faults. However, the digital communication of the control panel needs to be very robust and is inherently insensitive to normal cable parameter variations so this type of loop monitoring is not capable of detecting cable problems until the communication starts to fail, which usually causes a total unrecoverable collapse and makes the cause of the fault difficult to find.

Turning now to the system shown in the figures, this application describes a number of embodiments set in the context of monitoring systems and, more particularly, the use of loop monitoring and calibration techniques in a loop monitoring system that operates from within an analog addressable fire alarm system and that operates, in particular, for the detection and location of series resistance faults.

The loop monitoring system is applicable to any analog addressable fire alarm systems, such as loop-based systems within building management system(s). Typical exemplary systems that may be applicable to the present application include fire alarm panels, intruder detection systems, voice alarm systems, access control systems, nurse call systems, disabled toilet alarms, and disabled refuge systems.

In one illustrated embodiment, the loop monitoring is applied to a 2-wire loop that connects the control panel of a monitoring system with the sensors of the monitoring system. This system described below operates to improve the reliability of a monitoring system by detecting faults in the 2-wire loop. The loop monitoring system relies upon the measurement of series loop resistance, for example, in an analog addressable fire alarm system using a 2-wire loop that also provides combined power transmission and data communication. This, however, does not exclude other loop parameters being used.

Under illustrated embodiments, two different techniques may be used to measure small changes in the loop resistance. The first technique obtains an accurate overall resistance on each conductor leg and the total loop resistance. The resistance measurements are then used as calibrated values saved in memory to monitor for small changes and, hence, to detect faults. The second technique measures the resistance between outstations. As this is typically a fraction of an Ohm on a normal loop, a small change in any resistance value between points compared to the overall loop resistance value can easily be detected as a fault and used to locate the fault position. It should be noted that, because wiring faults nearly always occur at wiring termination points, it is this position that needs to be located and reported. In other words, the reported location will be at an outstation address or loop connection position.

The first measurement technique measures the loop resistance in a communication low level. For example, the control panel may transmit a message including a sequence of "1" s and "0" s, wherein the "0" s represent the communication low levels.

A virtual outstation with an unused loop address (i.e., a non-existent sensor) is used by the panel during the measurements. This implies that all of the actual outstations will ignore the measurement, and normal loop communication can otherwise be maintained. Since the measurements occur only during a logic low level, only the measurement current will be flowing from a current source within the control panel during the measurement so that an accurate resistance reading can be obtained without any errors due to quiescent or alarm currents.

Resistance measurements are then calculated for the total loop and each leg of the loop. The values are then analyzed to ensure that they are suitable, in other words, within the limits that would be expected, are not marginal, and are stable. The resistance values are then stored in memory and used as calibrated values to monitor for relativity small percentage changes and, hence, used to indicate a fault condition. The calibration values are normally taken when a back-up of the loop configuration is made to non-volatile memory (NVM) after the commission stage of the system.

The second technique differs in that it uses a sequential scan of the actual outstations connected to the loop. If we assume, for simplicity, that each device along the loop is sequentially addressed and will reply in location order, then its data communication (responses) can be monitored for its reply voltage level, i.e., the voltage level during a logic low level during a reply as measured from a particular end of the loop wiring. The panel will then take a respective analog to digital (ADC) measurement of the reply voltages at each end of the loop from each outstation.

If we also assume that accurate current sources are used in the panel during the communication reply from an outstation and that the impedances of all outstations are equal when transmitting this logic low level, then the resistance between each outstation can be calculated from the difference between two ADC values obtained in sequential order when measured from a particular end of the loop.

All of the resistance values between each outstation and the resistance values between the first and last outstation connected to the panel can then be calculated and recorded. The values are then analyzed and, if suitable, can be used as calibrated values so that changes in one or more of the resistance values can be used to detect and locate the position of resistance faults. The calibration values are normally taken when a back-up of the loop configuration is made to non-volatile memory (NVM) after the commission stage or initial startup of the system.

Any of the previously described resistance measurement techniques could be used independently. However, if both methods are employed together, then an overall benefit occurs. Absolute accuracy in the total loop resistance and in the resistance of each conductor (each leg) can be made and compared to the maximum values allowed for a certain loop configuration. The actual resistance values can then be monitored for small changes indicating a fault at an early stage before the loop could be compromised. Additionally, the location of one or more resistance faults could easily be detected and located on the loop.

FIG. 1 is a block diagram of a monitoring and/or security system 10 that incorporates the loop monitoring system discussed above. In a broader context, the monitoring system may be embodied as a fire detection system by itself or may provide other additional features, such as intrusion detection.

As shown, the monitoring system includes a number of sensors and/or alerting devices (outstations) 12, 14 that detect threats within a secured area 16. The sensors may include one or more of any of a number of different types of sensors (e.g., smoke detectors, heat detectors, carbon monoxide detectors, etc.).

If the system also performs intrusion detection, then the sensors may include limit switches placed on the doors and/or windows providing entrance into and egress from the secured area. The system may also include motion detection capabilities provided by passive infrared (PIR) detectors or closed circuit television (CCTV) cameras with one or more associated processors that compare a sequence of images for differences indicating motion.

The sensors may be monitored by a control panel 18. Upon detecting activation of one of the sensors, the control panel may send an alarm message to a central monitoring station 20. The central monitoring station may respond by summoning help (e.g., fire department, police, etc.).

The sensors are connected to the control panel via at least one 2-wire loop 22. The 2-wire loop supplies power to each of the sensors and provides a communication connection.

Included within each of the sensors and control panel is control circuitry that accomplishes the functionality described below. The circuitry may include one or more processor apparatuses (processors) 24, 26 operating under control of one or more computer programs 28, 30 loaded from a non-transitory computer readable medium (memory) 32 within the control panel and within a current sensor 34 and a voltage sensor 36. As used herein, reference to a step performed by a computer program is also reference to the processor that executed that step.

For example, a loop processor may monitor each of the sensors on a 2-wire loop. If a fire is detected at one or more of the sensors, then the loop processor may activate the alarm devices in one or more of the secured or protected areas, depending on the cause and effect programmed into the fire alarm system. A main processor may also compose and send an alarm message to the central monitoring station. The alarm message may include an identifier of the monitoring system (e.g., an account number, address, etc.), an identifier of the type of alarm (e.g., fire, intrusion, etc.), an identifier of the activated sensor, a location of the sensor within the secured area, and a time of activation.

Figure 2:
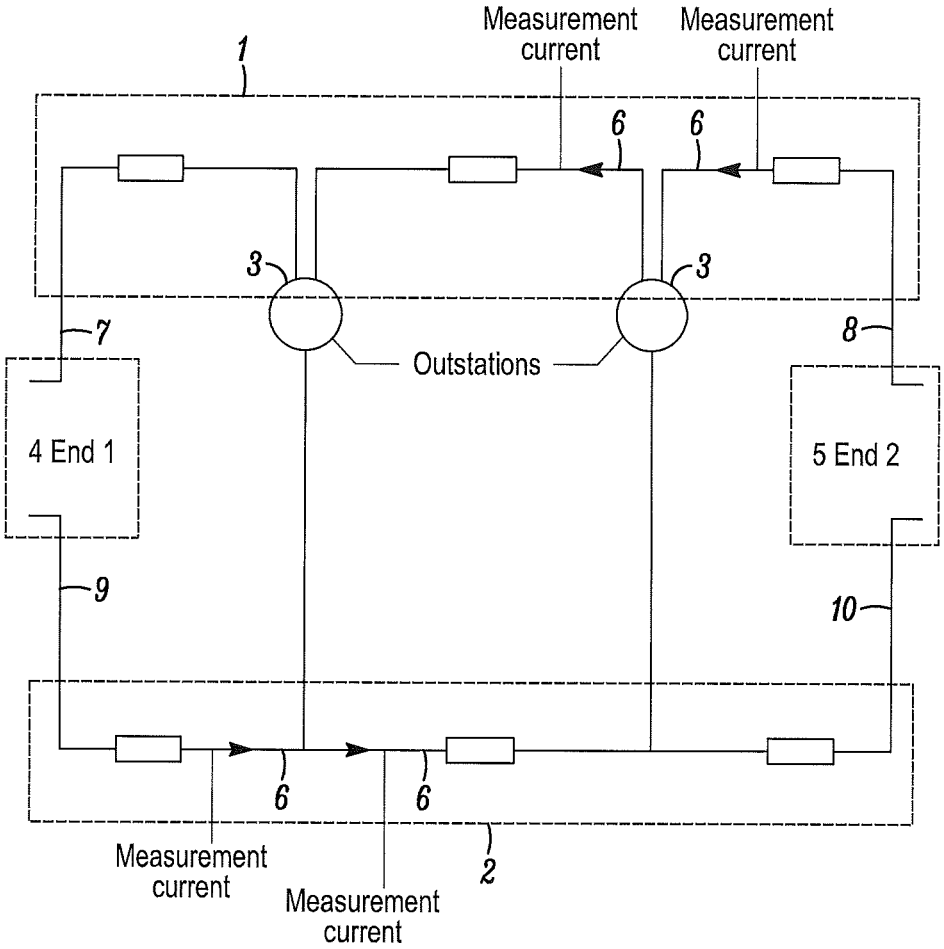
FIG. 2 is a simplified loop circuit diagram of an analog addressable fire alarm system of the system of FIG. 1 when conducting a loop resistance and calibration test.
Figure 3:
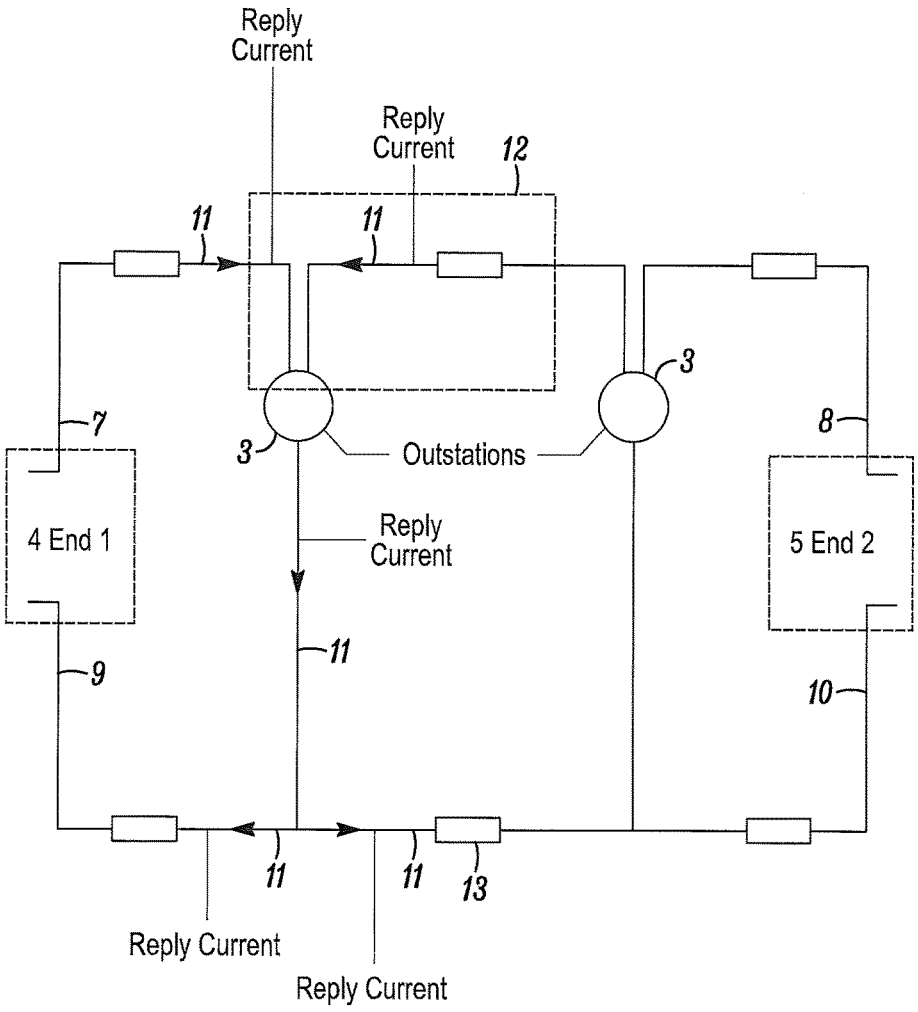
FIG. 3 is a simplified loop circuit diagram of an analog addressable fire alarm system of the system of FIG. 1 when conducting a resistance, calibration, and location test.

The loop monitoring system shown in the system of FIG. 1 may be described in more detail using FIGS. 2 and 3. FIG. 2 is a simplified circuit diagram of an analog addressable fire alarm system used by the system of FIG. 1 when conducting a loop resistance and calibration test, and FIG. 3 is a simplified circuit diagram of an analog addressable fire alarm system of the system of FIG. 1 when conducting a resistance, calibration, and location test.

FIG. 2 shows a simplified diagram of the fire alarm loop 22 of FIG. 1. The loop includes a first conductor (identified by reference number 1 in FIG. 2) and a second conductor (identified by reference number 2 in FIG. 2). One or more processors of the loop monitoring system may access the first and second conductors when conducting a loop resistance and calibration test. The resistance measurements are taken during a transmitted communication low level of the loop protocol using a current sensor 34 and a voltage sensor 36. A virtual outstation (sensor) with an unused loop address is used by the panel during the measurements so that all of the actual outstations will ignore the measurement, and normal loop communication can be maintained. In this communication low level, an accurate measurement current 6 is injected into End2 of the loop 5 and travels through the total resistance of the positive leg 1 into End1 of the loop 4. It should be noted that the total resistance of the positive leg 1 also includes the isolator resistance of all outstations 3.

The same measuring current 6 also flows in the total resistance of the negative leg 2, returning back to End2 of the loop 5. Measuring the voltage difference via a voltage sensor 36 between the End1 positive 7 and the End2 positive 8 and then dividing by the measurement current 6 gives the total resistance of the positive leg. Similarly, measuring the voltage difference between the End1 negative 9 and the End2 negative and then dividing by the measurement current 6 gives the total resistance of the negative leg 2. The total loop resistance is, therefore, the sum of the total resistance of the positive leg 1 and the negative leg 2.

The values are then analyzed to ensure that they are suitable, in other words, within the limits that would be expected, are not marginal, and are stable. The resistance values are then stored in memory and used as calibrated values. These values are then monitored in the live system for relativity small percentage changes in resistance, and, hence, the panel can easily detect a fault condition. The calibration values are normally taken when a back-up of the loop configuration is made to non-volatile memory (NVM) after the commission stage of the system. It should be clear that the resistance fault limits are not fixed as the limits are dependent on the calibrated resistance values taken. Thus, a short loop will have a lower fault limit than a longer loop with more cable and outstation resistances.

It should also be noted that, while the resistance of a copper cable increases with temperature, both legs are equally affected and use the same measurement current, and, as a consequence, this variation can be compensated for by comparing the relative change in resistance of both legs. In other words, the system can be made more sensitive to a differential change in the resistance of the legs as this is indicative of a real wiring fault. It should be clear that relativity small changes to the resistance of any leg compared to the overall loop resistance can be reliably detected by the system to maintain the wiring integrity.

For example, a fault could be generated if one of the following equations is true:

$$R_loop > R_loop_cal \times 1.2 \quad 1)$$

$$R1 > R1_cal \times 1.2 \quad 2)$$

$$R2 > R2_cal \times 1.2 \quad 3)$$

$$|\Delta R1 - \Delta R2| > 5 \quad 4)$$

where:

R1 is the total resistance of the positive leg.

R2 is the total resistance of the negative leg.

R_loop is the total loop resistance or R1+R2.

R1_cal is the calibrated value of R1.

R2_cal is the calibrated value of R2.

R_loop_cal is the calibrated value of the loop resistance.

$\Delta R1 = 100 \times (R1 - R1_cal)/(R1_cal)$.

$\Delta R2 = 100 \times (R2 - R2_cal)/(R2_cal)$.

In general, FIG. 2 shows a simplified diagram of a fire alarm loop when conducting a resistance, calibration, and location test. A processor of the control panel connected to End1 of the loop 4 and End2 of the loop 5 communicates periodically with the outstations 3 using a sequential scan. If we assume, for simplicity, that each device is addressed and will reply in location order with its data communication monitored for its reply voltage level, i.e., the voltage level during a logic low level during a reply as measured from a particular end of the loop wiring, then a processor of the panel will then take an accurate analog to digital (ADC) measurement of the reply voltages at each end of the loop from each outstation.

Two accurate current sources in the control panel provide a reading of the reply current 11 during the low level of the communication reply from the scanned outstations 3. As the outstations 3 have equal impedances, the voltage levels measured on End1 of the loop 4 and End2 of the loop 5 enable the resistance between each outstation to be calculated from the difference between two ADC values obtained in sequential order from one end of the loop to the other when measured from a particular end of the loop. This technique will even work if the loop is split as both ends of the loop are fed by separate current sources, and the resistance calculations can easily take this change of monitoring current into account.

The resistance value between any two outstations 3 in location order includes the cable resistance between the particular two outstations in the positive leg, an outstation isolator resistance 12, and the cable resistance between the particular two outstations in the negative leg 13.

All of the resistance values between each outstation and the resistance values between the first and last outstation connected to the panel can then be calculated and recorded. The values are then analyzed and, if suitable, can be used as calibrated values so that small changes in one or more of the resistance values can be used to detect and locate the position of resistance faults. The calibration values are normally taken when a back-up of the loop configuration is made to non-volatile memory (NVM) after the commission stage of the system. The actual resistance values (taken during normal operation) can then be monitored for small changes indicating a fault at an early stage before the loop could be compromised.

For example if a user were to assume:

ΔV_End1≈I_reply (AR) and

ΔV_End2≈I_reply (AR)

then, the value of the resistance between each outstation can be calculated, calibrated, and fault limits set as:

$$\Delta R > (\Delta R_cal \times 1.2) + 1$$

where:

ΔV_End1 is the variation in voltage measured between outstations as seen from End1.

ΔV_End2 is the variation in voltage measured between outstations as seen from End2.

I_reply is the reply current during a low level from an outstation.

ΔR is the resistance between particular outstations.

ΔR_cal is the calibrated resistance between particular outstations.

Any of the resistance measurement techniques shown in FIG. 2 or in FIG. 3 could be used independently to detect a fault. However, if both methods are employed together, then an overall benefit occurs. Absolute accuracy in the total loop resistance and in the resistance of each conductor (each leg) can be established by measurement and compared to the maximum values allowed for a certain loop configuration. The location of one or more resistance faults could, thus, easily be detected.

In FIG. 3, for example, with less than 1 Ohm between outstations, a fault could be detected if more than a 200% change in resistance were to occur. However, this could be equivalent to an increase of just over 1% in the total loop resistance. It is, therefore, possible to reliably determine very small resistance faults with the actual position on the loop determined using the outstation addresses.

While specific illustrated implementations have been described above in relation to fire alarm systems, the present invention is equally relevant and applicable to other loop-based systems typically within a building management system and also to systems that include fire alarm panels, intruder detection systems, voice alarm systems, access control systems, nurse call systems, disabled toilet alarms, and disabled refuge systems. Such systems will likewise benefit from the inherent advantages resulting from the present invention. Implementation of the present invention to these other forms of system would be evident to the skilled man.

The loop monitoring system described above is applicable to analog addressable fire alarm systems and to loop-based systems with a building management system. Typical exemplary systems that may be applicable to the present invention include fire alarm panels, intruder systems, voice alarm systems, access control systems, nurse call systems, disabled toilet alarms, and disabled refuge systems. The method and system of the present invention provide accurate fault detection and location in analog addressable fire systems and other systems in circumstances that have not previously been possible.

In general, the system includes a 2-wire loop having first and second conductors that connect a monitoring system with a plurality of sensors of the monitoring system, the 2-wire loop having first and second ends connected to the monitoring system, a memory that contains first respective resistance values of the first and second conductors and second respective resistance values between the first and second ends and each of the plurality of sensors, and a processor that detects a fault in the 2-wire loop by measuring third resistance values from opposing ones of the first and second ends of the 2-wire loop during a sensor addressing cycle and compares the third resistance values with corresponding ones of the first and second respective resistance values in the memory.

Alternatively, the system may include a monitoring system that protects a secured geographic area, a plurality of sensors of the monitoring system that detects threats within the secured geographic area, a 2-wire loop having first and second conductors that connect the plurality of sensors and the monitoring system, the 2-wire loop having a first end connected to the monitoring system and a second end also connected to the monitoring system, a first set of memory locations that contain a first respective resistance value of each of the first and second conductors, a second set of the memory locations that contain a second respective resistance value between the first end and each of the plurality of sensors and between the second end and each of the plurality of sensors, and a processor that detects a fault in the 2-wire loop by measuring third resistance values from opposing ones of the first and second ends of the 2-wire loop during a scan of the plurality of sensors, wherein a message is sequentially sent to each of the plurality of sensors, and compares the third resistance values with corresponding ones of the first and second respective resistance values of the first and second sets.

Alternatively, the system may include a fire detection system that protects a secured geographic area, a plurality of fire sensors of the fire detection system that detects fires within the secured geographic area, a 2-wire loop having first and second conductors that connect the plurality of fire sensors and a control panel of the fire detection system, the 2-wire loop having first and second ends, each of the first and second ends connected to the control panel, a memory that contains a first respective resistance value of each of the first and second conductors and a second respective resistance value between each of the first and second ends and each of the plurality of fire sensors, and a processor that detects a fault in the 2-wire loop by measuring third resistance values from at least one of opposing ones of the first and second ends of the 2-wire loop during a sensor addressing cycle and detects a difference between the third resistance values and corresponding ones of the first and second respective resistance values in the memory that exceeds a predetermined threshold value.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

a two-wire loop having first and second conductors that connect a monitoring system with a plurality of addressable sensors and alarm devices of the monitoring system, the two-wire loop having first and second ends connected to the monitoring system;

a memory that contains first respective resistance values of the first and second conductors and second respective resistance values between the first and second ends and between each of the plurality of addressable sensors and alarm devices; and a processor that detects a fault in the two-wire loop by measuring third resistance values from opposing ones of the first and second ends of the two-wire loop during a scan of the plurality of addressable sensors and alarm devices and compares the third resistance values with corresponding ones of the first and second respective resistance values in the memory.

2. The apparatus as in claim 1 wherein the monitoring system comprises a fire detection system.

3. The apparatus as in claim 1 wherein the processor sequentially measures the first respective resistance values of the first and second conductors and the second respective resistance values between the first and second ends and between each of the plurality of addressable sensors and alarm devices.

4. The apparatus as in claim 3 wherein the processor compares each of the third resistance values with the corresponding ones of the first and second respective resistance values in the memory and generates the fault upon one of the third resistance values exceeding one of the corresponding ones of the first and second respective resistance values by a predetermined amount.

5. The apparatus as in claim 1 wherein processor generates and transmits a message through one of the first and second ends into the two-wire loop, the message having high and low levels defining a destination address and a payload of the message.

6. The apparatus as in claim 5 wherein the processor measures one of the third resistance values of a portion of the two-wire loop during one of the low levels of the message.

7. The apparatus as in claim 5 wherein the destination address comprises a non-existent sensor.

8. The apparatus as in claim 5 wherein the processor sequentially transmits the message addressed to each of the plurality of addressable sensors and alarm devices connected to the two-wire loop.

9. The apparatus as in claim 5 further comprising a current sensor that measures a current through a portion of at least one of the first and second conductors and a voltage across the at least one of the first and second conductors during one of the low levels.

10. The apparatus as in claim 9 wherein the processor divides the voltage by the current to determine one of the third resistance values.

11. An apparatus comprising:

a monitoring system that protects a secured geographic area;

a plurality of addressable sensors and alarm devices of the monitoring system that detects threats within the secured geographic area;

a two-wire loop having first and second conductors that connect the plurality of addressable sensors and alarm devices to the monitoring system, the two-wire loop having a first end connected to the monitoring system and a second end also connected to the monitoring system;

a first set of memory locations that contain a first respective resistance value of each of the first and second conductors;

a second set of the memory locations that contain a second respective resistance value between the first end and each of the plurality of addressable sensors and alarm devices and between the second end and each of the plurality of addressable sensors and alarm devices; and a processor that detects a fault in the two-wire loop by measuring third resistance values from opposing ones of the first and second ends of the two-wire loop during a scan of the plurality of addressable sensors and alarm devices and compares the third resistance values with corresponding ones of the first and second respective resistance values of the first and second sets.

12. The apparatus as in claim 11 wherein the processor generates and transmits a message through one of the first and second ends into the two-wire loop, the message having a sequence of high and low levels defining one or more of a destination address and a payload of the message.

13. The apparatus as in claim 12 wherein the processor measures one of the third resistance values of a portion of the two-wire loop during one of the low levels of the sequence of high and low levels of the message.

14. The apparatus as in claim 12 wherein the destination address comprises a non-existent sensor.

15. The apparatus as in claim 12 wherein the processor sequentially transmits the message addressed to each of the plurality of addressable sensors and alarm devices connected to the two-wire loop.

16. The apparatus as in claim 12 further comprising a current sensor that measures a current through a portion at least one of the first and second conductors during one of the low levels of the sequence during transmission of the message.

17. The apparatus as in claim 16 further comprising a voltage sensor that measures a voltage across the at least one of the first and second conductors during the one of the low levels of the sequence during the transmission of the message.

18. The apparatus as in claim 17 wherein processor divides the voltage by the current to determine one of the third resistance values.

19. The apparatus as in claim 11 wherein processor measures the third resistance values following activation of the monitoring system and saves the third resistance values into the first and second sets of the memory locations.

20. An apparatus comprising:

a fire detection system that protects a secured geographic area;

a plurality of addressable fire sensors and alarm devices of the fire detection system that detects fires and annunciate the fires within the secured geographic area;

a two-wire loop having first and second conductors that connect the plurality of addressable fire sensors alarm devices and a control panel of the fire detection system, the two-wire loop having first and second ends, each of the first and second ends connected to the control panel;

a memory that contains a first respective resistance value of each of the first and second conductors and a second respective resistance value between each of the first and second ends and each of the plurality of addressable first sensors and alarm devices; and a processor that detects a fault in the two-wire loop by measuring third resistance values from at least one of opposing ones of the first and second ends of the two-wire loop during a scan of the plurality of addressable fire sensors and alarm devices and detects a difference between the third resistance values and corresponding ones of the first and second respective resistance values in the memory that exceeds a predetermined threshold value.

* * * * *